US005150486A

United States Patent [19]

Wu

[11] Patent Number: 5,150,486

[45] Date of Patent: Sep. 29, 1992

[54] MATTRESS WITH SHEET RETAINING MEANS

[76] Inventor: Chang-Fu Wu, No. 69, Alley 69, Lane 285, Sec. 1, Nei Hu Rd., Taipei, Taiwan

[21] Appl. No.: 869,965

[22] Filed: Apr. 17, 1992

[51] Int. Cl.[5] ..... A47C 27/00

[52] U.S. Cl. ..... 5/460; 24/72.5; 24/559

[58] Field of Search ..... 5/460, 496, 498, 504.1, 5/658; 24/72.5, 559

[56] References Cited

U.S. PATENT DOCUMENTS 2,549,001 4/1951 Palsson ..... 5/460

2,643,399 6/1953 Haeflinger ..... 5/460

*Primary Examiner*—Alexander Grosz

*Attorney, Agent, or Firm*—Fleit, Jacobson, Cohn, Price, Holman & Stern

[57] ABSTRACT

A mattress having channels on the bottom edge along the four sides thereof respectively aligned with channel plates, said channel plates having clamps secured by screws along inner peripheral edges thereof for clamping down a linen sheet permitting it to be covered over the mattress and firmly retained in place. Peripheral projections with raised portions are respectively made on said channel plates to increase friction force in securing a linen sheet to said mattress.

1 Claim, 3 Drawing Sheets

MATTRESS WITH SHEET RETAINING MEANS

BACKGROUND OF THE INVENTION

The present invention relates to mattresses, and more particularly, the present invention relates to such a mattress having clamping means arranged on the bottom edge along the four sides thereof for securing a linen sheet in shape. The clamping means comprises channel plates attached in channels on the mattress, and clamps secured to the channel plates by screws for clamping down the linen sheet which covers over the mattress.

The mattress for a bed is generally made in a rectangular shape having hems around the top and bottom borders. When in use, a linen sheet is positioned over the mattress with its peripheral edge inserted into the gap between the mattress and the bedstead. Because the linen sheet is simply retained in place by the pressure of the mattress, it wrinkles easily.

SUMMARY OF THE INVENTION

The present invention proposes to eliminate the aforesaid problem. According to one aspect of the present invention, there is provided a mattress having channels on the bottom edge along the four sides thereof respectively attached with channel plates, which channel plates each having clamps attached to a longitudinal peripheral edge thereof by screws for clamping down a linen sheet covering over the mattress, and a peripheral projection with raised portions along an opposite longitudinal peripheral edge thereof for clamping down the clamps in securing the linen sheet in shape.

According to another aspect of the present invention, each channel plate defines a space therein behind the peripheral projection thereof for receiving the border portion of the linen sheet which has been covered over the mattress.

DETAILED DESCRIPTION OF THE PREFERRED EMBODIMENT

Figure 1:
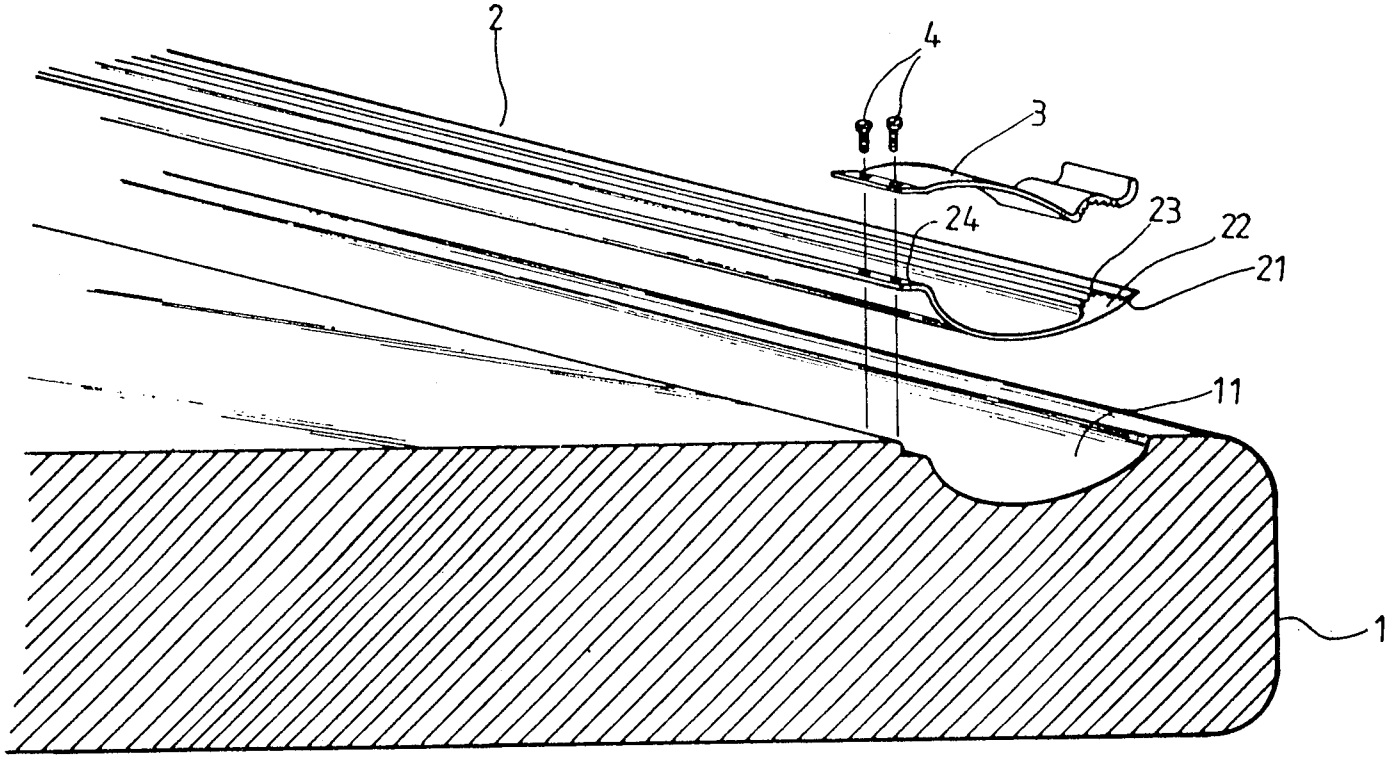
FIG. 1 is a partly exploded view of the preferred embodiment of the present invention.
Figure 2:
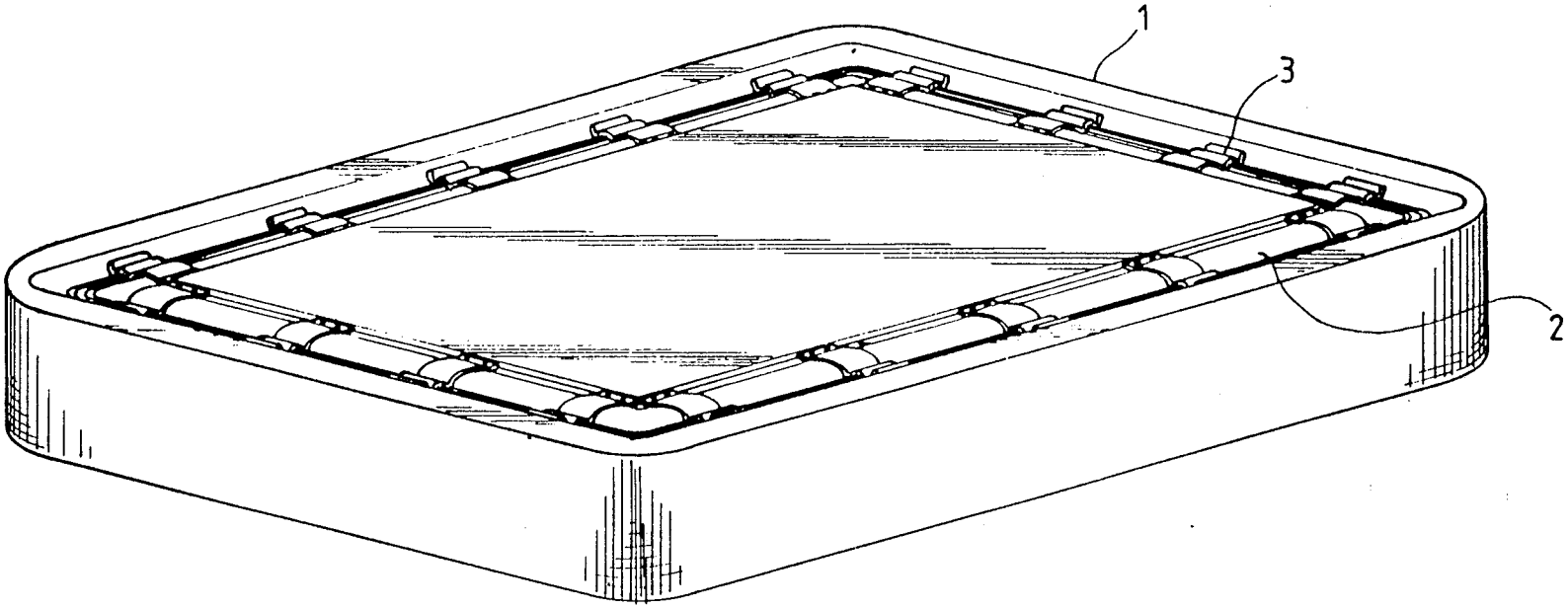
FIG. 2 is an elevational view of the preferred embodiment of the present invention.

Referring to FIGS. 1 and 2, the present invention is generally comprised of a mattress body 1, a plurality of channel plates 2, a plurality of clamps 3, and a plurality of screws 4. The mattress body 1 has channels 11 on the bottom edge along the four sides thereof respectively alined with channel plates 2. Each channel plate 2 has an elongated projection 22 along a longitudinal peripheral edge 21 thereof, and a plurality of spaced bolt holes (not indicated) along an opposite longitudinal peripheral edge 24 thereof for fastening screws, wherein the elongated projection 22 has a plurality of raised portions 23 over the top edge thereof. A plurality of clamps 3 are secured to the longitudinal peripheral edge 24 of each channel plate 2 by screws 24.

Figure 4:
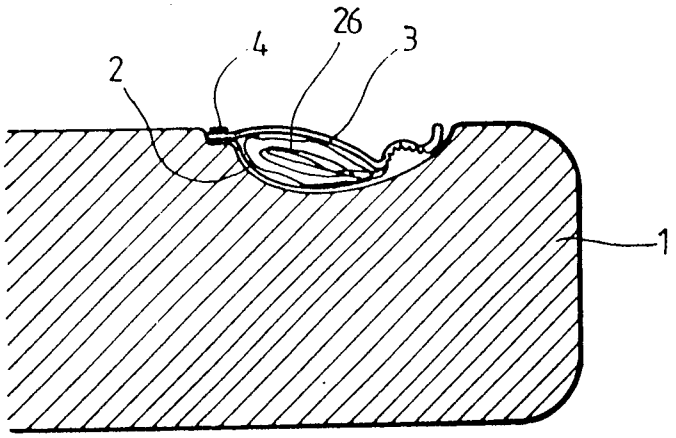
FIG. 3 and FIG. 4 are partly sectional views showing the operation of the present invention in securing a linen sheet.
Figure 3:
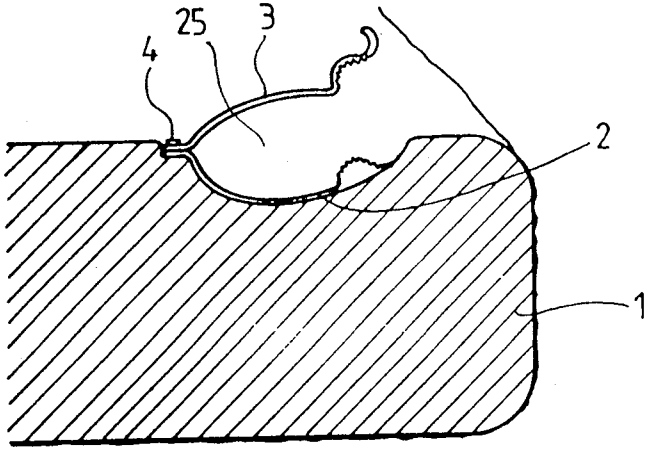

Referring to FIG. 3 and FIG. 4 the mattress body 1 is placed on a bedstead with the channels 11 disposed at the bottom. Once a linen sheet has been positioned over the mattress body 1, the peripheral edge of the linen sheet 26 is inserted into spaces 25 defined between the channel plates 2 and the clamps 3. By clamping down the clamps 3 over the elongated projections 22 of the channel plates 2, the linen sheet becomes firmly retained in place. By means of the arrangement of the raised portions 23 on the elongated projections 22 of the channel plates 2, a strong friction force is applied at the linen sheet against the clamps 3, and therefore, the linen sheet is firmly maintained over said mattress.

What is claimed is:

1. A mattress comprised of a rectangular mattress body, and a plurality of channel plates and clamps and characterized in that said mattress body has channels on a bottom edge along the four sides thereof with said channel plates respectively secured therein, said clamps being respectively secured to said channel plates said channel plates each having an elongated projection along a longitudinal peripheral edge thereof, said elongated projection having raised portions over a top edge thereof for clamping down said clamps in securing a sheet over said mattress body.

* * * * *